United States Patent [19]

Russell

[11] 4,227,266

[45] Oct. 14, 1980

[54] GROUND WATER LEVEL CONTROL SYSTEM

[75] Inventor: Clayton C. Russell, York, Pa.

[73] Assignee: Fox Pool Corporation, York, Pa.

[21] Appl. No.: 962,343

[22] Filed: Nov. 20, 1978

[51] Int. Cl.[3] ..... E04H 3/16; F16L 5/00

[52] U.S. Cl. ..... 4/496; 52/169.5; 52/169.7; 137/362; 405/37; 4/506

[58] Field of Search ..... 4/172, 172.15, 172.16, 4/172.17, 172.19, 172.21; 116/229, 228; 52/169.5, 169.7, 169.8; 210/169; 405/37, 43, 45, 229; 137/362, 412; 134/168 R, 169 R

[56] References Cited

U.S. PATENT DOCUMENTS

| | | | |
|---|---|---|---|
| 2,130,498 | 9/1938 | Klemschofski | 405/45 |
| 2,432,887 | 12/1947 | Haviland | 405/37 |
| 2,984,050 | 5/1961 | Crooks | 52/169.7 X |
| 3,017,722 | 1/1962 | Smith | 405/43 |
| 3,090,849 | 5/1963 | Coulin | 137/412 |
| 3,425,175 | 2/1969 | Gerde | 52/169.5 |
| 3,427,662 | 2/1969 | Jacuzzi et al. | 4/172.19 |
| 3,739,405 | 6/1973 | Schmidt | 4/172.15 |
| 3,748,810 | 7/1973 | Mattingly | 52/169.7 X |
| 3,908,385 | 9/1975 | Daniel | 405/37 |
| 4,060,946 | 12/1977 | Lang et al. | 52/169.7 |

FOREIGN PATENT DOCUMENTS

| | | | |
|---|---|---|---|
| 1237518 | 6/1960 | France | 116/229 |

*Primary Examiner*—Stuart S. Levy

[57] ABSTRACT

A system for controlling ground water level in a particular surrounding area is disclosed. In particular, a dewatering system to safeguard the integrity of an in-ground swimming pool against damage or disruption caused by excess water accumulating at or near the soil surrounding the swimming is described. Such contiguous ground water, when it rises to an undesirably high level, for example, such as at a level higher than the level of water in a swimming pool, as a consequence of the resulting hydrostatic pressure, will cause adverse effects. The invention provides a system for the removal of ground water accumulating in a given area in excess of a predetermined level, such as around a swimming pool, until the desired level is restored.

10 Claims, 6 Drawing Figures

GROUND WATER LEVEL CONTROL SYSTEM

BACKGROUND OF THE INVENTION

1. Field of the Invention

This invention relates to a system for controlling the level of ground water in a particular area and, more particularly, to a system for dealing with the effect of ground water contiguous to a swimming pool 2. Statement of the Prior Art In many areas of the country, the ground water level is relatively high and close to the surface of the ground. Also, during periods of heavy rain, excessive water can accumulate at or near the level of the ground, depending on local soil types and conditions. These phenomena can result in the ground water level rising to a level which can disrupt a ground installation. In the case of an in-ground swimming pool, the ground water can rise at an elevation higher than the level of water in the pool. When this occurs, hydrostatic pressure can adversely affect the swimming pool structure. In the case of a swimming pool that has a vinyl liner, this condition will cause the liner to displace or float. In the case of concrete or other swimming pools, this hydrostatic pressure becomes excessive and has the effect frequently of disrupting the integrity of the swimming pool structure through shifting or dislodging of the wall and/or floor. In fact, the pressure can cause the swimming pool to actually raise out of the ground.

The hydrostatic pressure is the result of a difference in head between the water level external to the swimming pool and internal water elevation. It is apparent that a need exists for a system to safeguard against or minimize the adverse effects on a swimming pool due to hydrostatic pressure from elevation of ground water levels.

SUMMARY OF THE INVENTION

In accordance with the invention, a novel system is provided which protects a swimming pool against damage, shifting, tilting, etc., due to the presence of excess water from whatever source. Such excess water may result from a rise in ground waters contiguous to the swimming pool due to a variety of causes, e.g. from flooding, natural or accidental, tides, excessive rain, etc. The present invention has as its purpose the provision of means for the detection and removal of undesirable excess water for periods until the water is restored to the desired predetermined level.

The dewatering system comprises of the following primary components:

A. A container, receptacle or collecting zone where water accumulates.

B. A float interconnected with a switching device.

C. Control means or connector to signal a remote location.

D. Piping connected to a pump at remote location.

E. Optimally, when employed with an in-ground swimming pool, a fitting for adapting the collector to the main drain of the swimming pool, is provided.

In accordance with the invention, a dewatering arrangement comprising a receptacle or reservoir in which water freely is collected, is placed at a suitable location contiguous to the pool and below the surface of the ground. The device is preferably surrounded by porous substrate such as gravel and/or other coarse media which will permit excessive water to percolate to and be collected in the receptacle or reservoir-like collector from which the water collected can be evacuate. Hereafter the collector, accumulation zone, container or reservoir, will be referred to as the container. Preferably, the container walls themselves are porous, such that water will collect freely in the container and will rise in the container as the level of the water in the ground rises.

A water level indicator is used such that, for example, as the water collects in the container, the float rises with the water level until a predetermined elevation. At the predetermined elevation, a switch is closed which transmits a signal to a remote location near the pool to activate a pump to remove the accumulated water from the container. As the water recedes below a predetermined level, the pump actuated by the signal of the falling float, is shut off. Other suitable alternate arrangements may be used to sense the water level and actuate the water evacuating pumps.

The necessary electrical hardware, such as transformers, relays, ground fault circuit interrupters and other conventional component elements to make this device safe to use around swimming pools are located in a control box near the pump or at any suitable location.

Multiple collector units may be used at any swimming pool site, for example, by placing one or more around the perimeter of the pool, or at the perimeter and main drain concurrently. The device may also be used without a pump; in such situation, it would be used, for example, to activate a signal, light or audio alarm to alert an operator to turn on a pump.

DETAILED DESCRIPTION OF THE INVENTION

Figure 1:
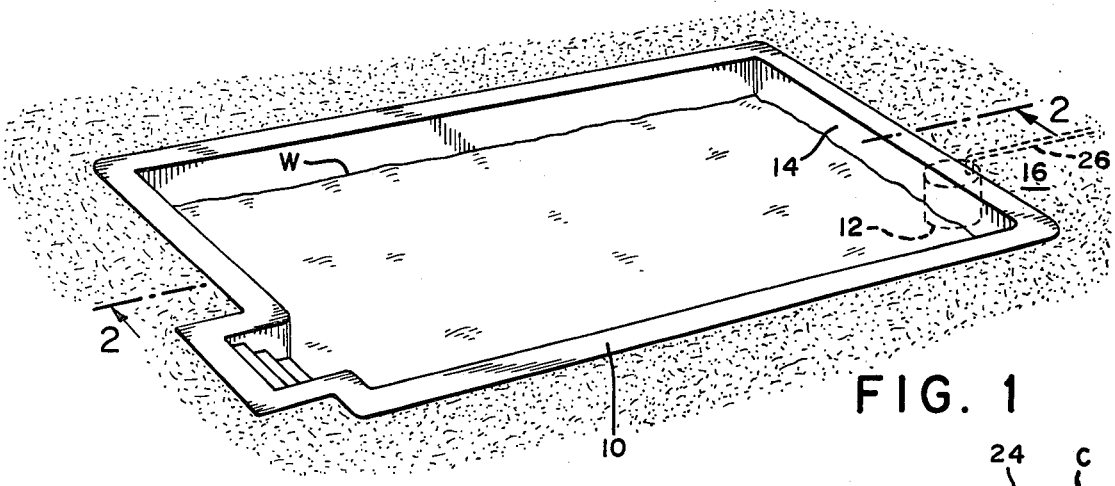
FIG. 1 is a perspective view of a swimming pool depicting, in broken line, the submerged accumulator or collector to effect dewatering in accordance with the present invention.
Figure 2:
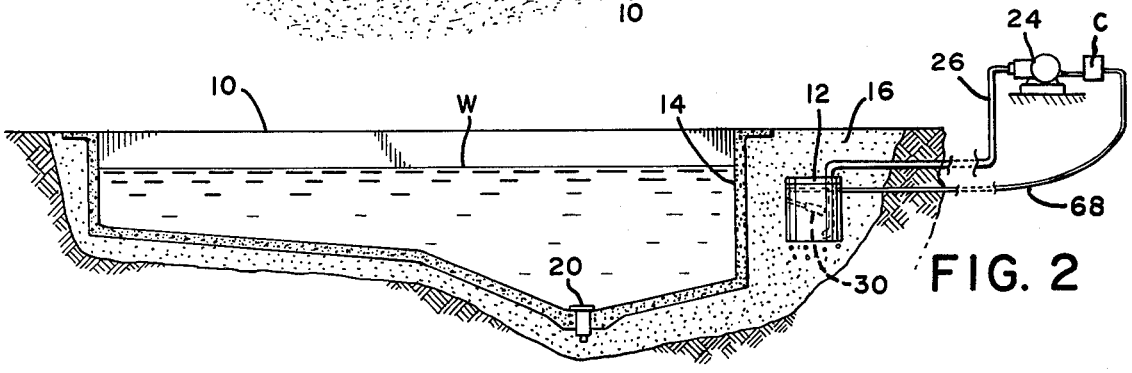
FIG. 2 is a cross sectional view taken along line 2—2 of FIG. 1.

Referring now more particularly to FIGS. 1 and 2 of the drawing, a swimming pool 10 is illustrated as having a dewatering unit or collecting reservoir 12 located outside and contiguous to one of the pool walls 14. The reservoir or container 12 is positioned beneath the surface of a substantially porous ground fill 16 surrounding the pool 10, the top of the accumulator or water collecting container 12 being below the level W of the water in the pool. The arrangement is such that excessive water in the ground contiguous to the swimming pool will collect in the container 12.

A remotely located pump 24 removes the water from the device 12 through a connecting pipe 26 when the pump is actuated such as when a mercury switch 28 (FIG. 5) is closed, energizing an electric motor which drives the pump 24. The switch 28 is enclosed in a float 30 which is buoyed up by the water in the container 12 and so arranged, via suitable electrical control C, such that when the water rises to a predetermined elevation the switch 28 which activates an evacuation pump, is closed, activating the pump 24. When the water recedes to a lower predetermined level, the switch 28 is opened and the pump ceases operating.

Figure 3:
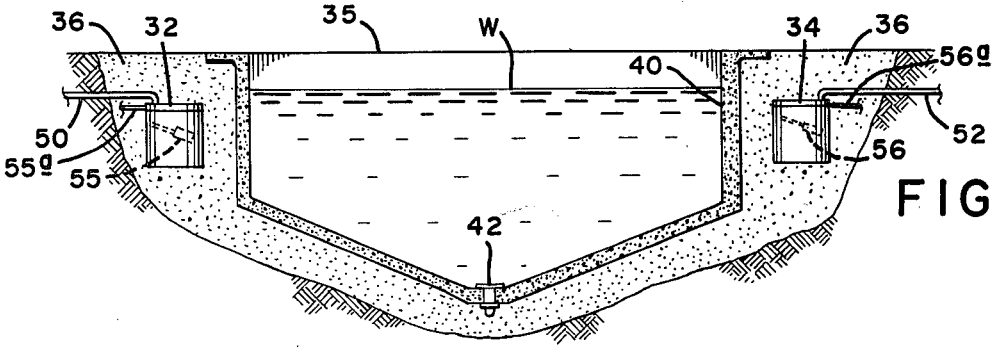
FIG. 3 is a sectional view taken transversely of a swimming pool showing two dewatering collecting devices.

Under some conditions, it may be desirable to use a plurality of appropriately situated dewatering accumulator units, such as the two 32 and 35, shown in FIG. 3 at the sides of the pool 35. The water evacuation devices are installed in a manner to assure efficient functioning, such as described above, regarding the free flow to the accumulator of excess water by use of a relatively porous ground-fill 36 and with respect to positioning of the collector relative to the water level W in the pool.

In the system of FIG. 3, the collector device 32 is provided with an evacuation pipe 50 and device 34 with a similar pipe 52 which are preferably connected to a common pump (not shown). Of course, if desired, each device may be connected to an independent pump. The water level in the collecting devices 32 and 34 is controlled in the manner described above by the use of floating switches 55 and 56, respectively, and connected to a control device (not shown) similar to C in FIG. 2 by means of associated electrical cables 55*a* and 56*a*, respectively. The control box C is equipped with the necessary relays, ground fault circuits and other electrical connectors.

Figure 4:
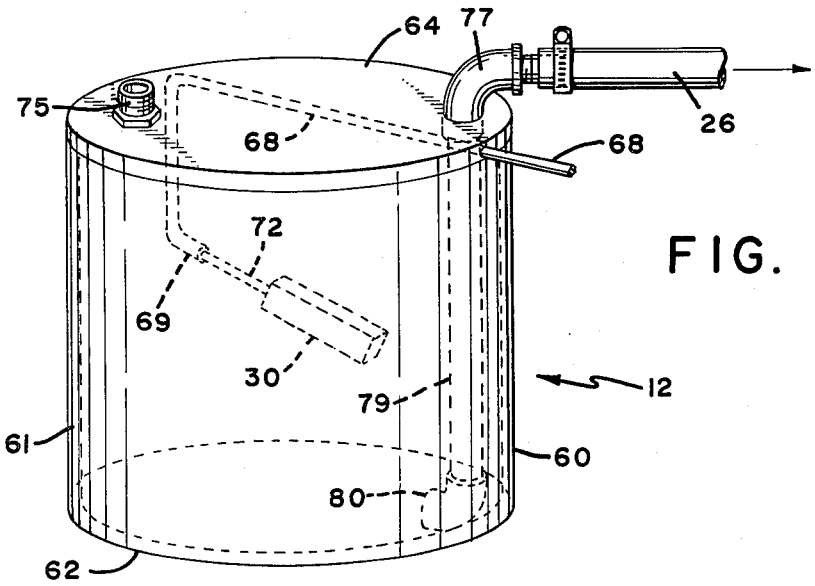
FIG. 4 is a perspective view of a typical dewatering collector device.
Figure 5:
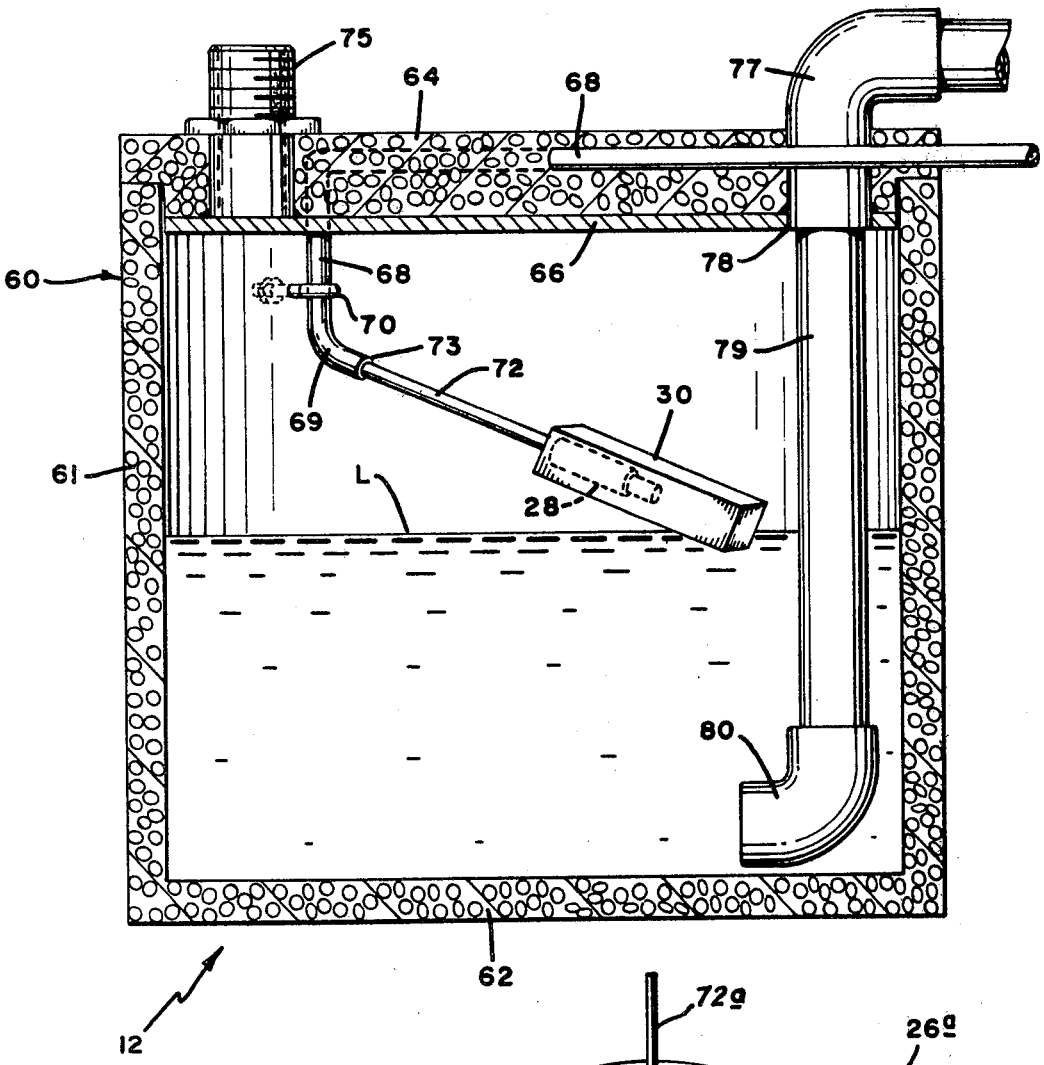
FIG. 5 is a vertical cross sectional view taken substantially central of the device of FIG. 4.

Referring to the enlarged detail of the dewatering device shown in FIGS. 4 and 5, the dewatering arrangement 12 comprises a container or reservoir 60 having a side wall 61 and bottom wall 62 formed of suitable porous construction to permit ready passage of water through the walls, e.g. a construction of washed stone held together by an epoxy resin. It will be apparent that a container of any other suitable construction, which provides a relatively porous enclosure that permits water to percolate into the container from the surrounding earth for the purpose of controlling the ground water level with respect to the pool water, may be employed. A cover 64 is secured to the sidewall 61 of the container in any suitable manner such as by use of an epoxy resin. The cover 64 is preferably of construction similar to the side wall 61 and is secured to a separator plate 66 of any suitable material such as stainless steel. A waterproof cable 68, as shown, may be encapsulated in the cover, one end of which passes through a hole in the separator plate 66 and leads to a flexible elbow 69 within the container 60. The other end of the cable 68 extends through the side of the cover to the motor of a remote pump such as 24 of FIG. 2. Alternatively, the cable may be inserted in any suitable manner through the sides of reservoir 60.

The float 30 together with the encapsulated mercury switch 28 is attached by a tube 72 to the free end 73 of the flexible elbow 60 which allows substantial vertical movement of the float 30 as it follows the level L of the water within the container. The elbow 69 is suitably secured to the container wall 61 such as by a nylon eyebolt 70.

A second fitting 77 is similarly attached in a hole 78 in the separator plate 66 for connecting the pipe 26 leading to the pump 24. An extension pipe 79 depends from the fitting 77 to a point adjacent the bottom wall 62 for drawing the water out of the lower zone of the container. A 90 degree elbow 80 may be optionally secured to the lower end of the extension 70 to aid in more efficiently exhausting the water. The fitting 75 provides a suitable option to permit the dewatering device to be connected for use with the main drain.

It is thus seen that the invention provides a dewatering system for use in conjunction with in-ground swimming pools to preserve the integrity and otherwise prevent damage to, and/or an undesirable condition surrounding, the swimming pool from accumulating ground water. The system uses a float mechanism situated in a water accumulating reservoir or container. When the float is raised by the increased water level, it actuates an electric switch and, through an electrical control mechanism, a water evacuation pump is started and continues as long as the water level in the container is above a predetermined level. When the water level drops to below the predetermined elevation, the control mechanism actuated by the float switch inactivates the pump.

Figure 6:
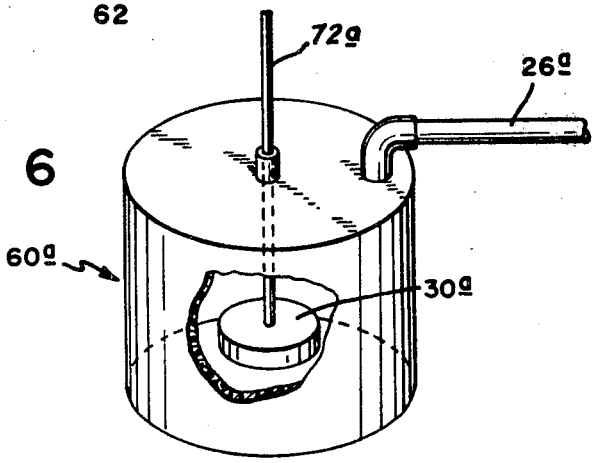
FIG. 6 depicts an alternate collector/float assembly.

Although the system is preferably operated automatically, it will be apparent that the dewatering system of the invention can also be used without an automatic engagement of the pump. In this connection, an arrangement as shown in FIG. 6 may be utilized in which a float 30*a* in the container 60*a* is connected via rod 72*a* to an externally visible vertical marker (not shown). When the float 30*a* is raised by the rising water level and the visible marker connected to rod 72*a* has been lifted by rising water to a predetermined "unsafe" level, the operator engages an evacuation pump to withdraw water through pipe 26*a* from the chamber 60*a* into which water continues to enter until the ground water has been depleted to the desired safe level.

Moreover, although the invention as described is preferably used and has its most advantageous benefit in conjunction with an in-ground swimming pool, it will be apparent that the dewatering system of the invention may also be used advantageiously with above ground pool installations to minimize any adverse effects of increased ground water levels on such installations also. Further, the invention may be used in any local where disruption from elevated levels of ground water can occur such as contiguous to tennis courts, for example.

It will be apparent that numerous variations and modifications may be made to the invention disclosed without departing from the underlying inventive concept and still come within the scope of the appended claims.

I claim:

1. A system for controllng ground water in an area which would be disrupted by rising ground water, comprising a water permeable container positioned in said area, a porous substrate contiguous to said container through which ground water freely passes into the container from the area to be controlled, a cover for said container wherein means for detecting the level of ground water in the container and means for evacuating water from the container are mounted, separator means on the lower surface of said cover, said water level detecting means extending through a side of said cover in a horizontal fashion and downwardly through said separator means, said evacuating means being attached to said separator means said means for detecting the level of ground water including water level indicator comprising a float depending into said container to indicate the rise above a predetermined level of ground water in said area, and means remote from said container and responsive to said indicator to effectively evacuate from said container water which is above the predetermined level in said container.

2. The system of claim 1 wherein the means to remove the water from said water permeable enclosure is effected automatically by an electrical interconnection between the signal means and the means to evacuate the ground water from said enclosure.

3. The system of claim 1 wherein said area is that contiguous to a swimming pool.

4. The system of claim 2 wherein said area is that contiguous to an in-ground swimming pool.

5. A system for controlling the level of ground water contiguous to the outside of an in-ground swimming pool comprising a water permeable container into which contiguous water collects freely, said container being situated in the ground contiguous to the outside of the swimming pool and at a predetermined level relative to the normal level of water in the swimming pool, a porous substrate contiguous to said container, said container including a cover wherein means for detecting the level of water in the container and means for evacuating water from the container are mounted, separator means on the lower surface of said cover, said water level detecting means extending through a side of said cover in a horizontal fashion and downwardly through said separator means, said evacuating means being attached to said separator means said level detecting means including a float depending into said container, and an electrical relay activated by said float when said float is raised to a predetermined elevation by water passing through said porous substrate and into said container, and a dewatering pump connected to the evacuating means in said container and actuated by said relay to evacuate water from said container when the water level in said container is higher than a predetermined level and until the water level has been restored to a level not in excess of said predetermined level.

6. The system of claim 5 wherein said collector comprises a removable top closure having formed therein and removable therewith a main drain connection fitting.

7. The system of claim 5 wherein said container comprises at least a bottom which is formed of a porous composition through which water in contact therewith flows freely.

8. The system of claim 5 wherein the container is positioned in a bed of gravel.

9. The system of claim 5 wherein a plurality of containers are positioned at spaced locations contiguous to said swimming pool and connected to said pump.

10. The system of claim 5 wherein the container is situated at the main drain of the swimming pool.

* * * * *